United States Patent [19]

Brealey et al.

[11] 4,434,723

[45] Mar. 6, 1984

[54] FLUIDIZED-BED COMBUSTION APPARATUS

[75] Inventors: Leslie Brealey; John H. Wilson; Niyazi Demircan, all of Derby, England

[73] Assignee: Northern Engineering Industries, Plc., England

[21] Appl. No.: 325,598

[22] Filed: Nov. 27, 1981

[30] Foreign Application Priority Data

Nov. 28, 1980 [GB] United Kingdom ..... 8038370

[51] Int. Cl.[3] ..... F23D 19/02

[52] U.S. Cl. ..... 110/245; 431/170; 122/4 D; 432/58

[58] Field of Search ..... 431/170; 122/4 D; 432/58; 110/245, 234, 322, 323, 326

[56] References Cited

U.S. PATENT DOCUMENTS

| | | | |
|---|---|---|---|
| 645,826 | 3/1900 | Nussbaum | 110/326 |
| 1,064,250 | 6/1913 | Primrose et al. | 110/322 |
| 1,457,443 | 6/1923 | Liptak | 110/326 |
| 1,652,157 | 12/1927 | Ashenden | 110/326 |
| 1,771,286 | 7/1930 | Brassert et al. | 165/9.2 |
| 1,916,458 | 7/1933 | Bigelow | 165/9.2 |
| 1,970,529 | 8/1934 | Walton | 431/170 |
| 2,033,911 | 3/1936 | Digby | 110/326 |
| 2,147,803 | 2/1939 | Steck | 110/322 |
| 2,198,054 | 4/1940 | Linder | 165/9.2 |
| 3,380,410 | 4/1968 | Venable, Jr. | 110/323 |
| 4,052,140 | 10/1977 | Highley | 431/170 |
| 4,267,801 | 5/1981 | Robinson | 122/4 D |
| 4,268,244 | 5/1981 | Dawson | 431/170 |
| 4,273,073 | 6/1981 | Robinson | 122/4 D |
| 4,338,887 | 7/1982 | Leon | 122/4 D |

*Primary Examiner*—Henry C. Yuen

[57] ABSTRACT

A fluidized bed shell boiler for producing steam or hot water or a fluidized bed hot gas generator or incinerator in which the position at which bed material is deposited downstream of the bed is controlled. A baffle of fire-brick with gas-flow passages extending through the baffle is positioned in the tube downstream of the bed.

Gas velocities are distributed across the tube so that bed material is preferentially deposited in the combustion chamber downstream of the furnace tube.

Deposition in the furnace tube is reduced to zero or to a negligible amount and deposition downstream of the combustion chamber is reduced.

1 Claim, 5 Drawing Figures

FLUIDIZED-BED COMBUSTION APPARATUS

BACKGROUND OF THE INVENTION

The invention relates to fluidised-bed combustion apparatus.

In this specification "combustion apparatus" includes boilers for supplying hot water or for heating other fluids, boilers for producing steam and apparatus for producing hot gas or for incineration.

Fluidised-bed apparatus such as shell boilers have typically for example a shell in which a horizontal furnace tube extends from a containment for a fluidisable bed to a combustion chamber.

In such boilers particles of bed material and ash are elutriated from the bed and are conveyed by the gas leaving the bed for varying distances downstream of the bed. Some elutriant falls out of the gas stream and is deposited in the furnace tube. Some is conveyed right through the furnace tube and is deposited in the combustion chamber, for example. Some is deposited in the smoke-tubes and finer particles are conveyed to the rear smoke-box and even out through the smokestack. Generally, a grit-arrestor is provided to reduce the emission of fine particles from the stack as far as possible.

The rate of elutriation of material from the fluidised bed is dependent on the rate of firing of the boiler and upon the rate of flow of gas through the bed. The degree to which elutriant is deposited at any given point is dependent upon the rate of flow of gas, which in turn depends upon the rate of flow of gas through the bed and the rate of firing. The gas flow leaving the bed is not uniform, the rate of flow varying from point to point across the furnace tube.

For example, in a shell boiler rates at 10,000 lbs of steam/hour (4545 kg of steam/hour) which had a bed of alumina (having an initial bed weight of approximately 400 kg, a mean particle size of 700 um and a particle terminal velocity of 9.6 m/s at 950° C.), it was found that the combustion/fluidisation gasses (which has a velocity of approximately 32 m/s over a rear wall of the bed containment) elutriated approximately 112 kg/hour of bed material. Of that total of elutriated material, approximately 100 kg was deposited in the furnace tube and the combustion chamber and approximately 12 kg was deposited in the rear smoke-box.

BRIEF SUMMARY OF THE INVENTION

We have now found that a limit can be imposed on the distance which elutriated bed material is conveyed along the gas flow path by means of a baffle in the path.

Such a baffle can be used in boilers such as shell boilers whether for producing steam, hot water or for heating thermal fluid and also in other fluidised bed combustion apparatus, such as hot gas generators or combustors or incinerators.

According to the present invention, a fluidised bed combustion apparatus comprises a horizontal furnace duct extending from a containment for a fluidisable bed, the duct containing a baffle which is positioned in the path of gas flow from the containment and which at least partly defines a gas-flow passage or passages distributed across the duct so as to be present in part in the upper and lower half-volumes and the left and right half-volumes of the duct.

The baffle may define identical gas-flow passages extending through the baffle.

Each gas-flow passage through the baffle may increase uniformly in cross-sectional area in the direction of gas flow, at least over part of the length of the passage.

The baffle may comprise a wall of firebricks.

At least some of the firebricks may each have a gas-flow passage extending through the firebrick.

Alternatively, gas-flow passages may be defined between firebricks.

Alternatively, the baffle is composed of heat-resistant metal, ceramic or composite metal and ceramic material.

Fluidised-bed shell boilers will now be described to illustrate the invention by way of example only with reference to the accompanying drawings, in which:

DETAILED DESCRIPTION OF THE PREFERRED EMBODIMENTS

Figure 1:
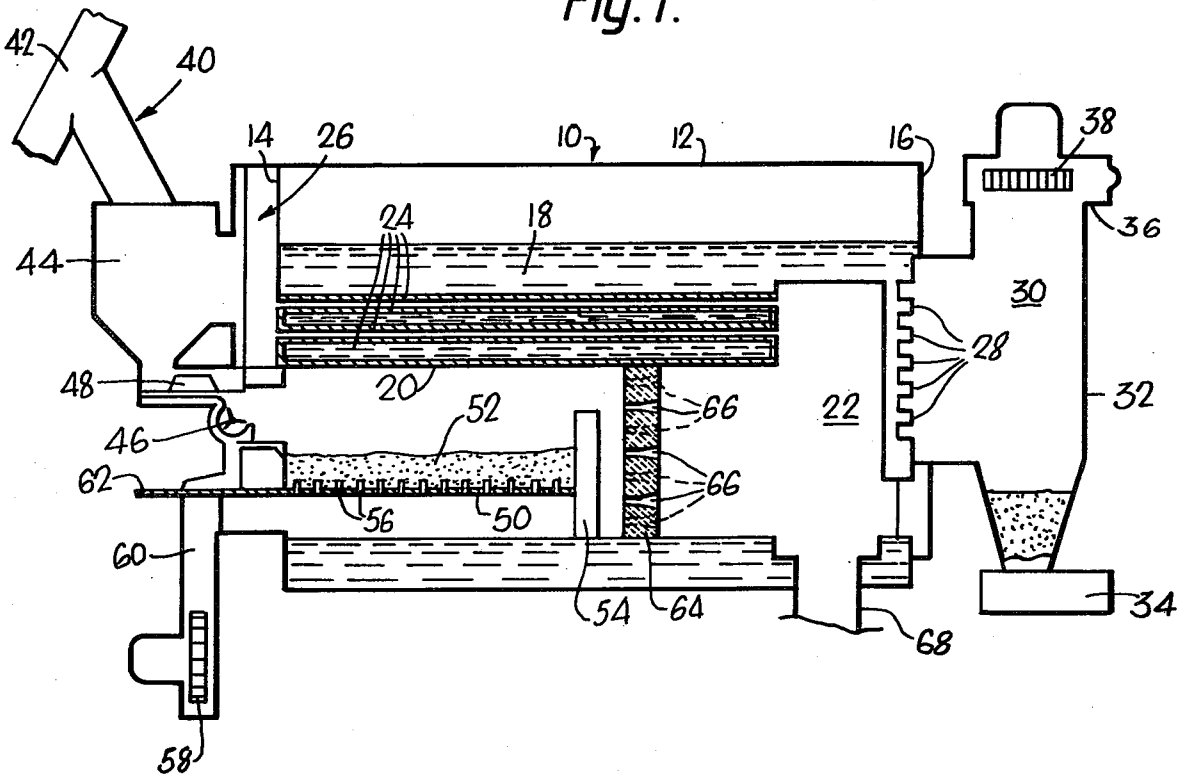
FIG. 1 is a vertical section through the boiler.
Figure 2:
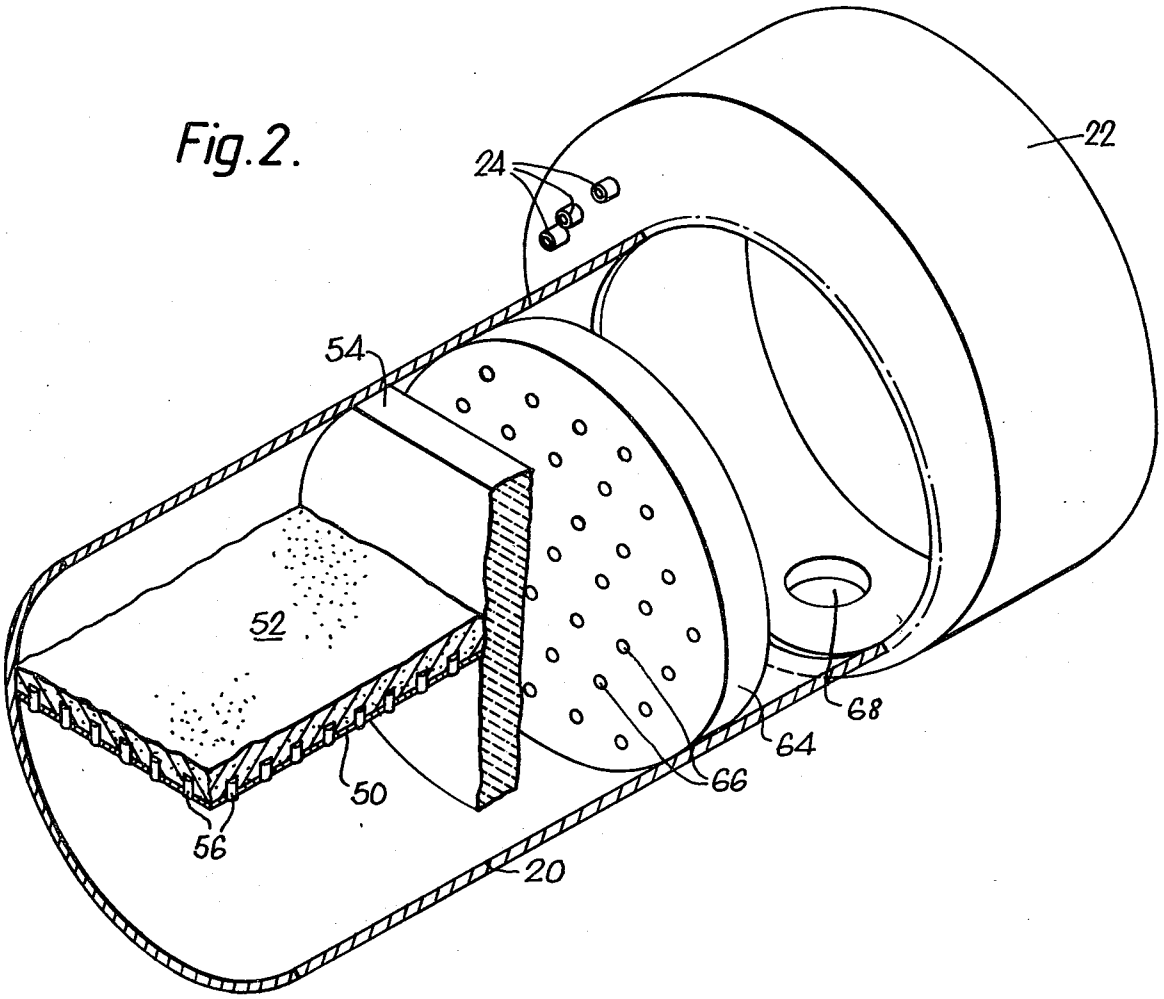
FIG. 2 is a cut-away perspective view of part of the furnace tube and the combustion chamber of the boiler.

The fluidised-bed shell boiler 10 (see FIGS. 1 and 2) has a shell formed by a horizontal cylindrical wall 12, a front wall 14 and a rear wall 16, the shell defining a water space 18. A horizontal furnace duct in the form of a tube 20 extends from the front wall 14 to a combustion chamber 22 which is located wholly within the water space 18 although in other constructions it could be outside, or only partly within, the water space 18. A first pass 24 of smoketubes extends from the combustion chamber 22 to a front smoke-box 26 and a second pass 28 of smoke-tubes extends from the front smoke-box 26 to a rear smoke-box 30.

The rear smoke-box 30 communicates with a cyclone-type grit-arrestor 32 for removing ash particles from the gas stream which are removed from the arrestor 32 for disposal by a pneumatic conveyor 34. The grit-arrestor 32 has a stack connection 36 through an induced-draught (I.D.) fan 38.

A solid-fuel feed arrangement 40 is located at the front of the boiler 10. The arrangement 40 includes a screw conveyor 42 for feeding coal from a bunker (not shown) to a hopper 44. Coal from the hopper 44 is fed to a spreader 46 by a rotary feeder 48.

A distributor plate 50 forms the base of a containment for a fluidisable bed 52 of particulate material, for example, alumina, in the furnace tube 20. The plate 50 is supported at its front and rear by the front wall 14 of the shell and by a bed-retaining wall 54 of refractory firebricks, respectively, and along its sides by the furnace tube 20, the walls 14 and 54 and the tube 20 completing the bed containment. The plate 50 has nozzles 56 through which fluidising air and fuel gas are introduced into the bed 52. The nozzles 56 that are at the periphery of the plate 50 and are adjacent the furnace tube wall are inclined to the plate 50 in a direction away from the centre of the plate 50.

Fluidising air is supplied to the furnace tube 20 below the plate 50 by a forced draught (F.D.) fan 58 communicating with the tube 20 through a duct 60. Fuel gas, for example propane, is supplied through lines 62 (only one shown) which have side pipes for feeding fuel gas directly into the nozzles.

A baffle 64 is located in the furnace tube 20 between the bed-retaining wall 54 and the combustion chamber 22. The baffle 64 consists of a wall of refractory firebricks which are laid across the furnace tube 20. Some of the firebricks have been moulded with gas-flow passages 66 through them, which passages 66 taper towards the wall 54.

The number, size and distribution of the passages 66 and the separation of the baffle 64 from the wall 54 are selected to cause the gas flow rate to be as far as possible uniform across the furnace tube. Preferably, the cross-sectional areas of the flow paths over the bed-retaining wall 54, between the wall 54 and the baffle 64 and through the baffle 64 (through the passages 66), are substantially equal.

For example, in a boiler having a furnace tube 20 of 1.267 m internal diameter, the following, are typical parameters, for example:

1. area of flow path over wall 54=0.25 $m^2$;
2. separation of wall 54 and baffle 64=0.2 m (the exact spacing to achieve equal areas=0.184 m);
3. area flow path formed at 2.=0.219 $m^2$;
4. the number of passages 66 in the wall 64=37;
5. the passages 66 were arranged in seven horizontal rows having a passage distribution (from top to bottom) of 4-5-6-7-6-5-4;
6. the pitch of the passages 66=0.18 m;
7. the diameter of each passage 66 at the end adjacent the bed-retaining wall=0.09 m;
8. the included cone angle of each passage 66=10°;
9. the total flow path area formed by the passages 66 (at their smaller ends)=0.24 $m^2$; and
10. the thickness of the baffle 64=0.29 m.

A chute 68 extends from the bottom of the combustion chamber 22 out through the cylindrical wall 12 of the shell. The chute contains a valve (not shown) which is normally closed but which is openable to allow elutriant to pass through.

The boiler 10 is started up by operating the fans 38 and 58 to fluidise the bed 52 slightly and by supplying fuel gas to the bed 52. The fuel gas is ignited at the bed surface and, as heat is imparted to the bed material, the flame boundary progressively approaches the plate 50. Once the temperature of the bed material is sufficiently high the feed arrangement 40 is operated to feed coal to the bed 52 and the fans 38 and 58 are operated to give the design through-flow of fluidising gases and relatively balanced conditions above the bed i.e. the pressure is slightly below atmospheric pressure above the bed. After a short period to allow the coal to ignite, the fuel gas supply is turned off. The feed arrangement 40 is then operated to supply coal to the bed 52 in response to the required steam demand from the boiler 10.

During running of the boiler 10, the velocity of gases passing from the bed 52 and over the bed-retaining wall 54 is for example 32 m/s, which is considerably higher than the terminal velocities of the particles of bed material and of ash. The maximum gas velocity in the combustion chamber 22 is consequently also above the terminal velocities of bed material and ash so that bed material would be conveyed into the smoke-tubes in considerable amounts if the invention were not used. Some ash particles that are small enough are carried right through the boiler to the grit-arrestor 32.

Since the gas flow paths are distributed across the furnace tube 20, the maximum gas flow rate downstream of the baffle 64 is relatively low compared with what it would otherwise be. Preferably, the maximum velocity downsteam of the baffle 64 is less than the terminal velocity of bed material. A preferred maximum is two-thirds the terminal velocity.

The baffle 64 thus limits the maximum distance to which at least a substantial portion of the elutriated bed material is conveyed downstream of the bed so that relatively little bed material is conveyed beyond the combustion chamber 22. Most of the elutriated bed material passing along the tube 20 is deposited in the combustion chamber 22 or in the chute 68.

A series of tests were performed using a test apparatus which comprised a full-size replica of the furnace tube, the bed containment, and the combustion chamber. A series of exit holes from the combustion chamber and a plenum chamber arranged to collect material passing through the holes simulated the boiler tube passes and the rear smoke-box.

The tests were conducted using unheated air at ambient temperature to simulate gas leaving the bed and using sand as the bed material. The depth of the slumped bed was 100 mm and the mean particle size was 755 micro-meter. The air speed over the bed-retaining wall was 14 m/s. The area of the bed was 2 $m^2$.

The tests showed that a baffle constructed to simulate a baffle built of firebrick and extending right across the furnace tube and spaced 200 mm from the wall 54 gave a very marked improvement in controlling the point at which elutriated bed material was deposited. In a test lasting 20 minutes only 0.13 kg of bed material was deposited beyond the combustion chamber.

Slightly more than 10 kg were deposited in the combustion chamber. No bed material was deposited in the furnace tube, save for a small amount which was deposited at the start of the test between the wall 54 and the baffle. That small amount did not increase during the remainder of the test.

The baffle used in the boiler described above was based on the baffle used in the tests and the depth and area of the fluidised bed are the same in the boiler as in the tests. Alumina is the bed material in the boiler having a mean particle size of 700 micro-meters.

For alumina in air at 950° Centigrade, for particles of such size and having a particle density of 4000 kg/$m^3$, the terminal velocity has been calculated as 9.60 m/s and the preferred maximum velocity downstream of the baffle 64 is then 6.40 m/s. For alumina particles of mean particle size of 1000 micro-meters and the same particle density the calculated terminal velocity is 14 m/s and the preferred maximum velocity downstream of the baffle 64 is 9.30 m/s.

Figure 3:
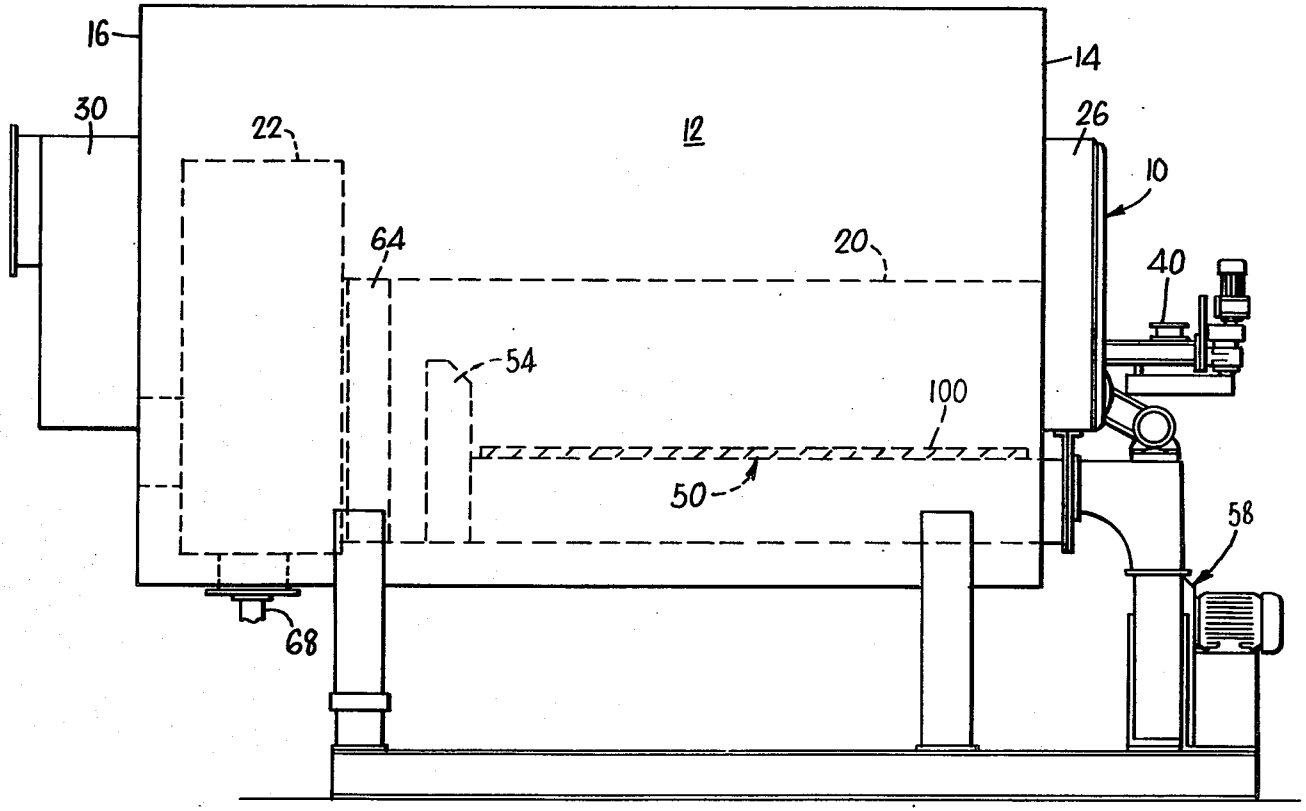
FIG. 3 is a side elevation of a modified boiler.

FIG. 3 shows a boiler in which the fluidised bed occupies a relatively greater length of the furnace tube. The same reference numerals have been used for parts corresponding to those shown in FIGS. 1 and 2.

Typically, for example, the fluidised bed is 2.837 m long and 1200 mm wide in a furnace tube of 1265 mm internal diameter.

The bed retaining wall 54 and the baffle 64 are shown diagrammatically and not necessarily to scale. However, the distance between them is 200 mm.

The baffle 64 in this case is positioned very close to the rear end of the furnace tube 20.

The nozzles through which fluidising air is supplied to the bed are indicated schematically by an envelope shown by broken lines at 100.

Figure 4:
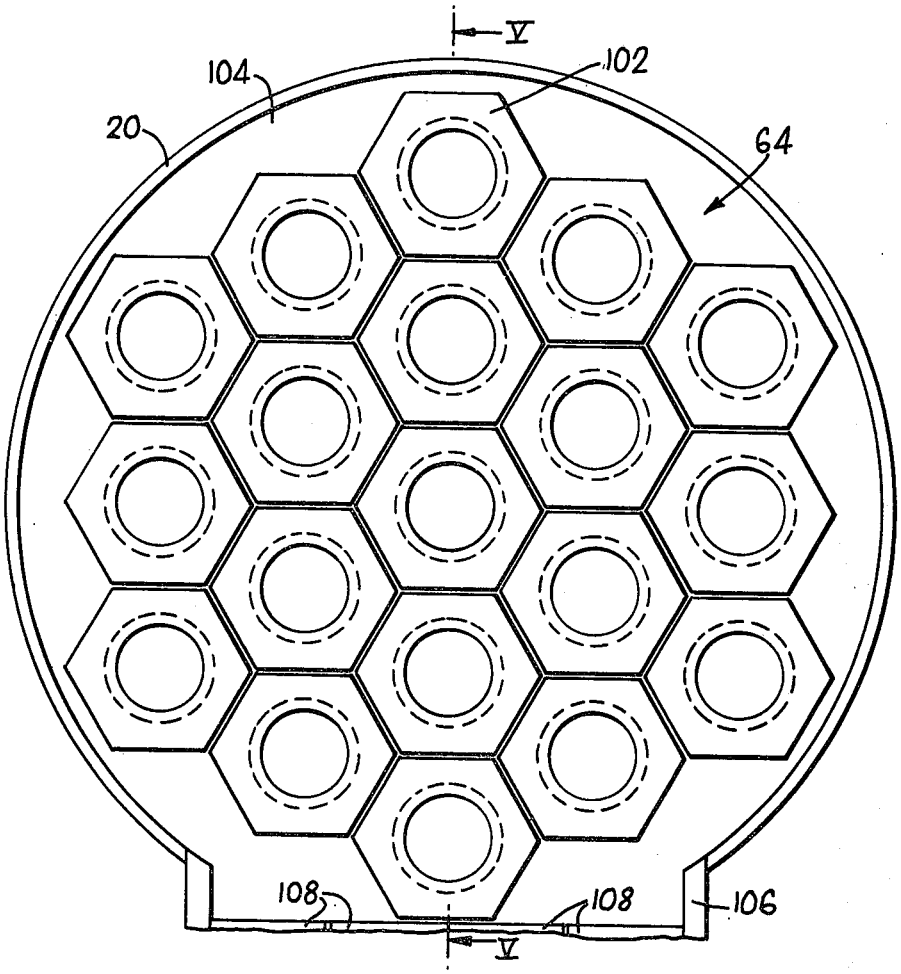
FIG. 4 is a part vertical section at IV—IV in FIG. 5 showing a baffle.
Figure 5:
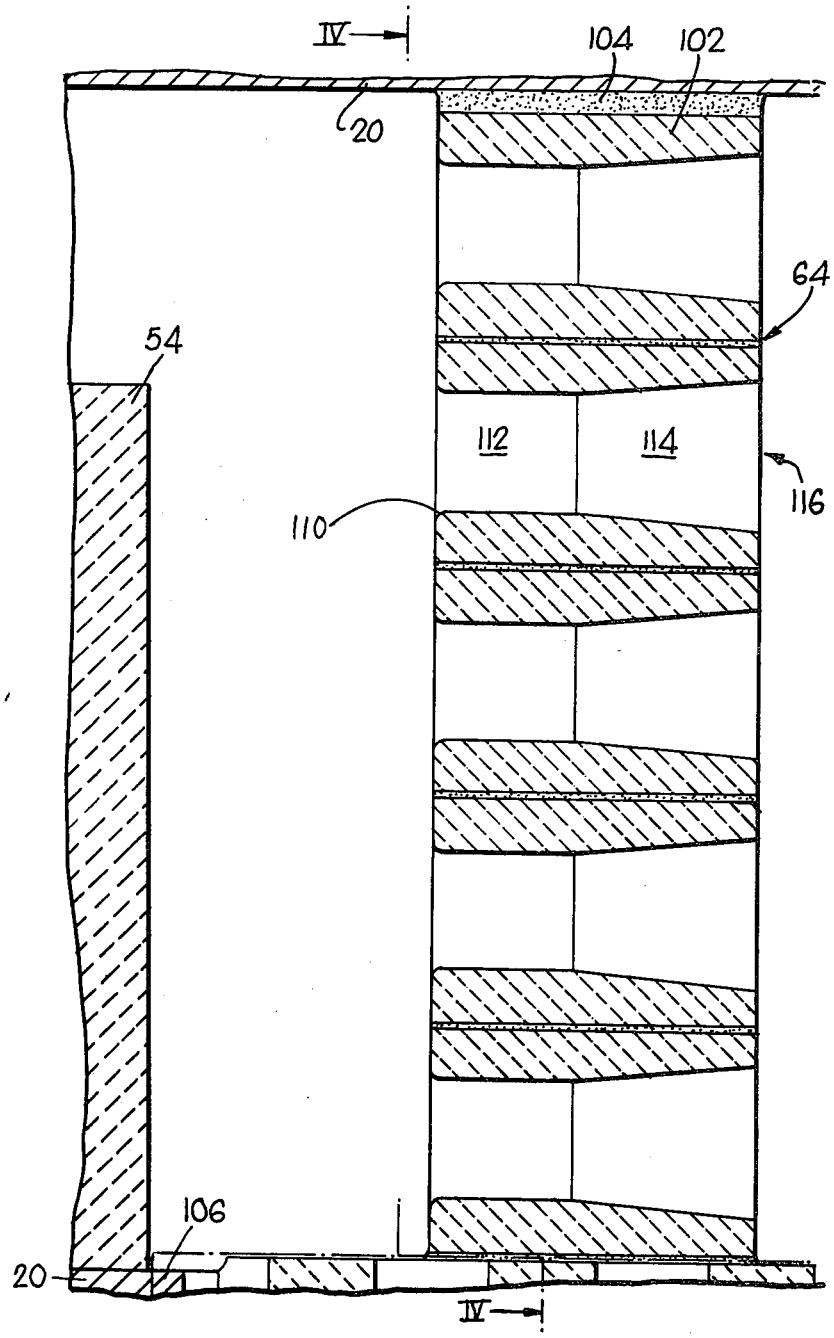
FIG. 5 is a section on V—V in FIG. 4.

FIGS. 4 and 5 show one form of construction of a baffle 64 in detail.

The baffle is built of nineteen hexagonal firebricks 102 cemented together by mortar arranged in this case to give a pattern of gas-flow passages which is different from those described above.

The baffle 64 includes make-up cement mortar shown at 104 which surrounds the array of bricks 102 and holds them in place in relation to the furnace tube 20.

In FIGS. 4 and 5 the baffle 64 is shown as built over a downwardly-extending chute 106. The chute 106 is closed by firebricks 108 and would provide for ash removal were a chain grate stoker fitted within the furnace tube instead of the fluidised bed.

A similar baffle 64 can be used in the boiler shown in FIG. 3 but the array of bricks 102 would then be oriented in a position 30° anticlockwise from the position shown in FIGS. 4 and 5 so that horizontal rows of gas flow passages would be present containing the following numbers of passages, beginning at the top row and proceeding downwardly: three; four; five; four and three.

Each brick 102 has a central gas flow passage having an entrance defined by a circular radiussed edge 110; a cylindrical section 112; and a frusto-conical section 114 which terminates at a circular exit 116.

The baffle shown in FIGS. 4 and 5 produces a gas flow rate downstream of the baffle of not more than 6.40 m/s where the rate over the bed retaining wall 54 is 32 m/s. Furthermore, the gas flow rate downstream of the baffle is highly uniform across the furnace tube, with very little departure anywhere from the average flow rate.

Although the baffle 64 has been described as having equally-sized gas-flow passages through the wall, many different patterns of passages, sizes of passages and constructions of baffle can be devised to give the improvement referred to above.

In a modification, not shown, the gas flow path may be only partly defined by the baffle. For example, an annular flow path or several flow paths may be defined between the baffle and the furnace tube.

Gas-flow passages through the baffle may be provided in addition to a gas-flow passage or passages defined between the baffle and the furnace tube, in a further modification.

Whilst preferred gas flow velocities have been quoted above, other velocities may be used in some applications, within the scope of the invention.

Instead of firebrick the material used for the baffle may be a heat-resistant metal such as an Incolloy or Hastelloy (Trade Names) steel; or ceramic material; or a complete metal and ceramic metal.

What is claimed is:

1. Fluidised bed combustion apparatus comprising:

(a) a horizontal furnace duct, (b) bed containment means within said duct, (c) particulate non-combustable inert fluidisable bed material forming a fluidisable bed in said containment means, (d) first means operable to feed particulate solid fuel to said bed in said containment means through an upstream end of said duct, (e) second means operable to feed air into said bed to fluidise the same, (f) said containment means comprising at a downstream end of said bed a bed-retaining wall extending upwardly above said fluidised bed when slumped and having an upper edge spaced from the duct thereabove forming an opening, (g) said first and second means being operable during combustion of fuel in said bed so as to cause generation of flue gases at velocities leaving said bed which results in inert bed material being elutriated in said flue gases and being carried thereby out of the containment toward a downstream end of the bed and through the opening between the duct and the bed-retaining wall, (h) a combustion chamber into which said duct opens located downstream of the bed-retaining wall, (i) horizontal firetubes located outside of said duct and connected downstream of and to the combustion chamber for receiving flue gases therefrom, (j) the maximum gas velocity of the flue gases passing through the opening over the said bed-retaining wall being considerably higher than the terminal velocity of elutriated bed materials carried therein with the result that, in the absence of other means, bed material would be undesirably conveyed by the flue gases into the said firetubes and thus be unrecoverable, (k) and means located downstream of the said containment means and in the flue gas path for reducing the maximum velocity of the flue gases downstream of the said containment means below the terminal velocity of the said bed materials to cause most of the elutriated bed material to be removed in the combustion chamber and thus to prevent substantial deposit of elutriated bed material in the firetubes, said velocity-reducing means comprising baffle means in said duct intermediate said bed-retaining wall and said combustion chamber, said baffle means comprising gas impermeable means spaced from said bed-retaining wall and having plural, spaced gas flow passages therein sized and distributed over the baffle means so as to reduce the flue gas flow velocity downstream of the baffle means below the maximum terminal velocity of the said bed materials so as to cause most of the elutriated bed materials to deposit in said combustion chamber and thus be recoverable therefrom, said gas flow passages comprising a plurality of identical flow passages extending through said baffle means in which each said flow passage diverges in the direction of gas flow therethrough, and said baffle means comprising a wall of bricks at least some of which each defines one said flow passage therethrough.

* * * * *